US005191933A

United States Patent [19]

Edwards et al.

[11] Patent Number: 5,191,933

[45] Date of Patent: Mar. 9, 1993

[54] WELLBORE APPARATUS INCLUDING A RATHOLE PRESSURE BALANCED-DIFFERENTIAL PRESSURE FIRING SYSTEM

[75] Inventors: A. Glen Edwards, Hockley; Klaus B. Huber; Joe C. Hromas, both of Sugar Land, all of Tex.; Antoni K. L. Miszewski, Budleigh Salterton, England; William M. Hill, Pearland, Tex.

[73] Assignee: Schlumberger Technology Corporation, Houston, Tex.

[21] Appl. No.: 877,340

[22] Filed: May 1, 1992

[51] Int. Cl.[5] ..... E21B 43/1185; E21B 34/10

[52] U.S. Cl. ..... 166/297; 166/55.1; 166/374; 166/386; 166/387; 175/4.52; 175/4.54

[58] Field of Search ..... 166/297, 55, 55.1, 374, 166/381, 386, 387, 317; 175/4.52, 4.54

[56] References Cited

U.S. PATENT DOCUMENTS

| | | | |
|---|---|---|---|
| 4,341,266 | 7/1982 | Craig | 166/317 |
| 4,484,632 | 11/1984 | Vann | 166/297 |
| 4,509,604 | 4/1985 | Upchurch | 166/297 X |
| 4,512,406 | 4/1985 | Vann et al. | 166/297 |
| 4,515,217 | 5/1985 | Stout | 166/297 |
| 4,526,233 | 7/1985 | Stout | 166/377 |
| 4,531,590 | 7/1985 | Peterson | 175/4.52 |
| 4,538,680 | 9/1985 | Brieger et al. | 166/55 |
| 4,544,034 | 10/1985 | George | 166/297 |
| 4,557,331 | 12/1985 | Stout | 166/297 |
| 4,560,000 | 12/1985 | Upchurch | 166/55.1 |
| 4,606,409 | 8/1986 | Peterson et al. | 166/297 |
| 4,650,010 | 3/1987 | George et al. | 175/4.54 X |
| 4,708,200 | 11/1987 | Salerni et al. | 166/55.1 |
| 4,817,718 | 4/1989 | Nelson et al. | 166/297 |
| 4,862,964 | 9/1989 | George et al. | 175/4.54 X |
| 4,880,056 | 11/1989 | Nelson et al. | 166/51 |

OTHER PUBLICATIONS

PCT System-Sleeve Type, A page from a book dated Jan. 1987 disclosing a hydrostatic reference tool having a pressure reference feature.

*Primary Examiner*—Stephen J. Novosad

*Attorney, Agent, or Firm*—Henry Garrana; John H. Bouchard

[57] ABSTRACT

A well apparatus adapted to be disposed in a wellbore includes a perforating apparatus and a packer adapted to set and isolate an annulus above the packer from a rathole annulus below the packer, the perforating apparatus including a new and novel rathole differential pressure balanced firing system where the firing system includes a ball release sleeve holding a firing piston, means for initially opening a top end and a bottom end of the ball release sleeve to the rathole annulus below the packer; and a plurality of sequentially operable hydraulic systems, the top end of the ball release sleeve being initially open to the rathole annulus below the packer but being subsequently closed to the rathole annulus below the packer and then reopened to the annulus above the packer when the packer is set. When the top end of the ball release sleeve is opened relative to the annulus above the packer and the significant pressure is applied to the annulus above the packer, the ball release sleeve releases the firing piston; as a result, since the firing piston is released, the firing piston drops and impacts a primer, the impact of the firing piston on the primer detonating the perforating apparatus.

10 Claims, 4 Drawing Sheets

FIG. 6a
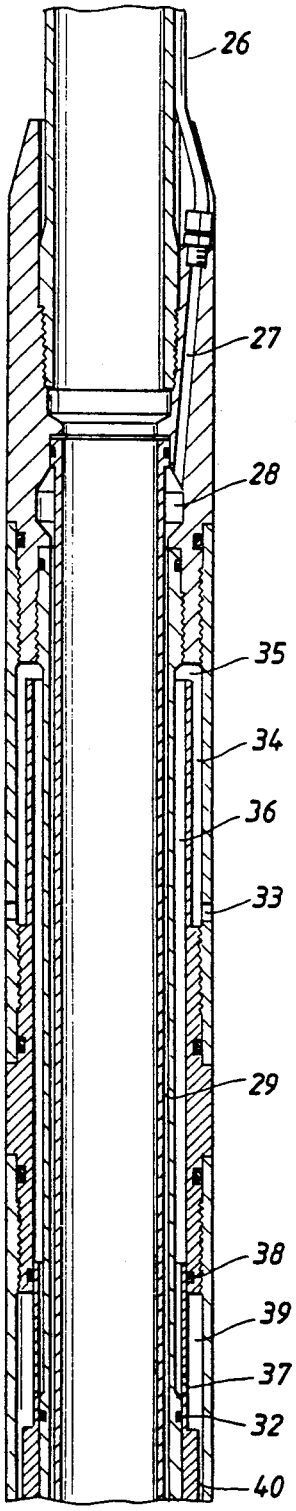
| |
|---|
| FIG. 6a |
| FIG. 6b |
| FIG. 6c |
FIG. 6b
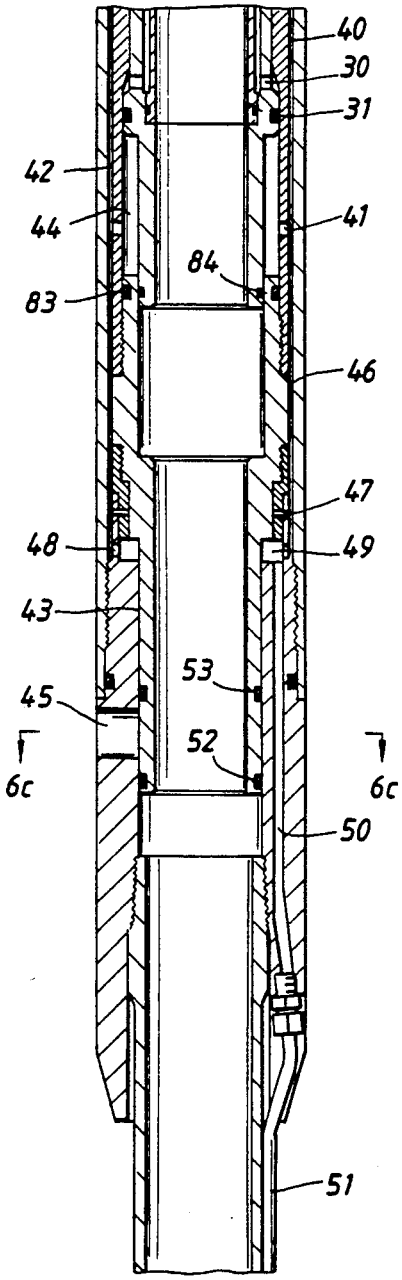
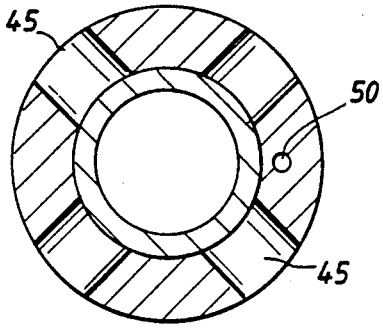
FIG. 6c FIG. 7a
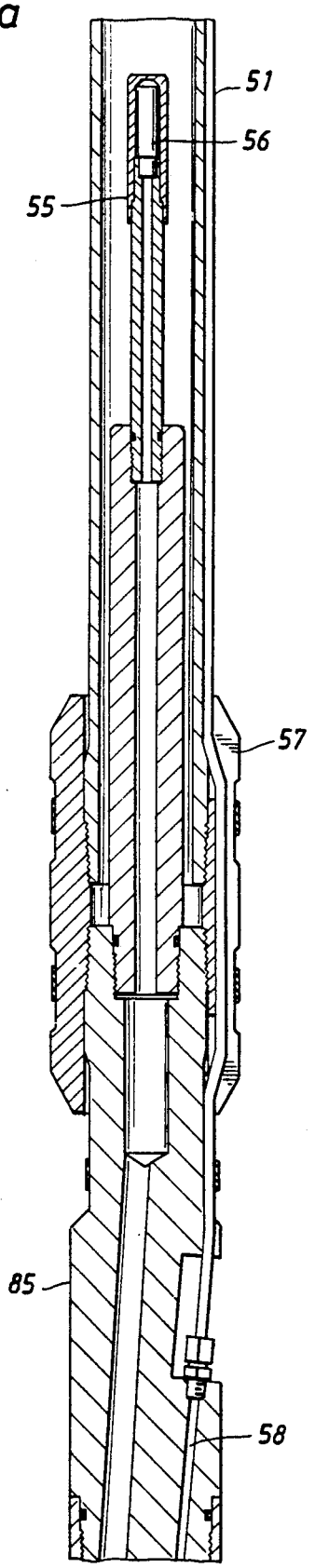
FIG. 7a
FIG. 7b
FIG. 7b
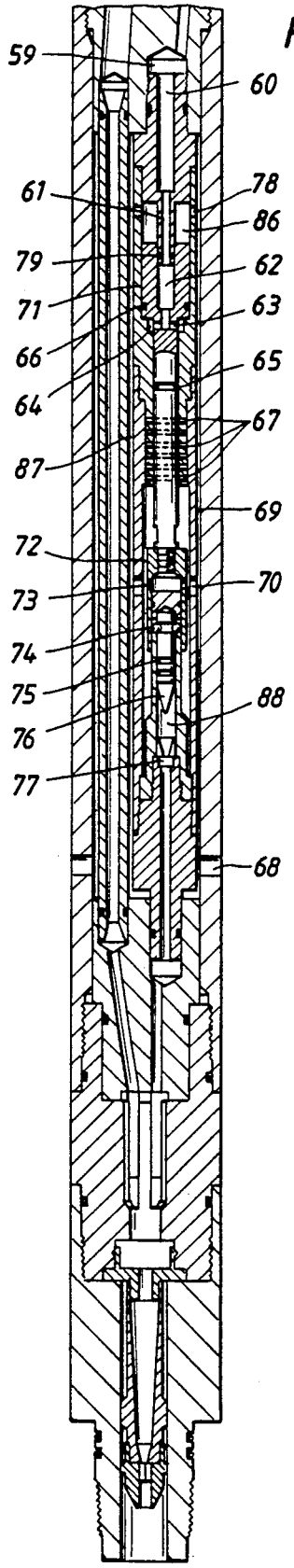

WELLBORE APPARATUS INCLUDING A RATHOLE PRESSURE BALANCED-DIFFERENTIAL PRESSURE FIRING SYSTEM

BACKGROUND OF THE INVENTION

The subject matter of the present invention relates to a firing system adapted for use in a perforating apparatus, and more particularly, to a differential pressure firing system disposed in a perforating apparatus adapted for use in a wellbore, the firing system maintaining the pressure above and below a firing apparatus pressure balanced at a rathole (hydrostatic) pressure and, by means of a plurality of sequentially operable hydraulic systems, maintaining the balanced rathole pressure across the firing apparatus until a packer is set and a pressure above the packer is increased to a level which exceeds the rathole hydrostatic pressure.

The concept of using differential pressure to fire a perforating apparatus is not new. For example, U.S. Pat. Nos. 4,817,718 and 4,880,056 to Nelson et al and U.S. Pat. No. 4,606,409 to Peterson et al disclose differential pressure fired perforating systems. In general, existing differential pressure fired perforating systems use the difference between annulus pressure above the packer and tubing pressure to power either a mechanical system or a hydraulic system, that is, an operating piston above the packer is always applying the annulus pressure above the packer to a side of a firing piston or a mechanical actuator; however, any movement of the firing piston or actuator is prevented by a tubing pressure being applied directly to the other side of the firing piston or mechanical actuator. However, in these existing systems, safety requires that the above the packer annulus pressure be maintained equal to the tubing pressure until such time that detonation of the perforating system is required. Only then can the annulus pressure above the packer be increased to a level greater than the tubing pressure below the packer.

One existing system is disclosed in U.S. Pat. Nos. 4,817,718 and 4,880,056 to Nelson et al. In order to maintain a margin of safety when using the existing system disclosed in the Nelson et al patents, a reference pressure chamber, located within the confines of the tool, is physically disposed below the firing piston and is filled with fluid at hydrostatic pressure; the annulus pressure above the packer is increased to a first pressure level; this closes off the reference pressure chamber and traps the fluid therein at the hydrostatic pressure thereby maintaining the pressure below the firing piston at the hydrostatic pressure; the annulus pressure above the packer is increased further to a second pressure level; this increases a pressure above the firing piston to a level above the hydrostatic pressure in the reference pressure chamber thereby creating a differential pressure and driving the firing piston onto a primer which detonates the perforating apparatus. However, since the reference pressure chamber is located within the confines of the tool, the firing piston is not open, at both ends, to an annulus area below the packer (also termed the "rathole annulus") prior to application of the differential pressure across the firing piston. Therefore, premature detonation of the Nelson system could occur because the Nelson firing piston is not truely pressure balanced prior to detonation. Since the firing piston is not open at both ends to the rathole annulus, the Nelson et al differential pressure firing system is classified as a "closed" system.

Still another existing system is disclosed in U.S. Pat. No. 4,606,409 to Peterson et al. At least for a short period of time, the system disclosed in Peterson et al may be considered an "open" system; that is, for a short period of time, the top and bottom ends of the firing piston are exposed to fluid pressure which exists within the rathole annulus. A check valve admits pressurized fluid into a pressure chamber disposed near the top part of the firing piston but immediately closes when the pressure chamber is full thereby trapping the fluid therein at hydrostatic pressure. However, when the check valve closes, since the top part of the firing piston is closed relative to the rathole annulus, the system is no longer considered to be an "open" system; rather, it is a "closed" system, one which may be subject to premature detonation due to unwanted pressure differences which exist between the top and bottom ends of the firing piston. Therefore, in order to maintain a margin of safety when using the system disclosed in Peterson, a locking sleeve piston prevents any premature movements of the firing piston toward a primer charge. Peterson's firing piston is actuated by bleeding off the pressure in the tubing string below the packer when the check valve is closed thereby reducing the pressure below the firing piston relative to the pressure existing within the pressure chamber.

However, none of the aforementioned existing systems are, at all times, open to the rathole annulus immediately prior to creating the differential pressure and actuating the firing piston; therefore, none of the existing systems may be truely classified as an "open" system. However, in-any event, none of the, existing systems maintain the firing piston or mechanical actuator pressure balanced at the rathole hydrostatic pressure by "opening" both ends of the firing piston or actuator to the rathole annulus below the packer and keeping both ends of the firing piston open to the rathole annulus until the packer is set and the pressure in the annulus above the set packer is increased to a point which exceeds the rathole hydrostatic pressure. In addition, the system disclosed in the Nelson et al patents requires that the distance between the packer and the firing head be limited in order to maintain the required differential pressure across the firing head which is necessary to detonate the firing head.

SUMMARY OF THE INVENTION

Accordingly, it is a primary object of the present invention to provide a differential pressure firing system adapted for use in a perforating apparatus, which system maintains a firing apparatus or mechanical actuator, and all other tools disposed below the packer, pressure balanced at rathole (below packer) hydrostatic pressure by opening both top and bottom ends of the firing apparatus or actuator to a rathole annulus below the packer and keeping both ends of the firing apparatus or actuator open to rathole hydrostatic pressure until the packer is set and a significant pressure, above the rathole hydrostatic pressure, is applied to the annulus above the packer.

It is a further object of the present invention to provide the differential pressure firing system which further includes a plurality of hydraulic systems disposed between the firing apparatus or actuator and the packer, the plurality of hydraulic systems being sequentially operated in response to the significant pressure, beginning with the uppermost oriented hydraulic system and ending with the lowermost oriented hydraulic system, when the packer has been set and the significant pressure is applied to the annulus above the packer, the bottom end of the firing apparatus being closed to rathole pressure and opened to annulus pressure above the packer when the plurality of hydraulic systems have been sequentially operated.

In accordance with these and other objects of the present invention, a well apparatus adapted to be disposed in a wellbore includes a packer and a perforating apparatus disposed below the packer in the wellbore. When the packer is set, it isolates an annulus above the packer from a rathole annulus below the packer. The perforating apparatus includes a new and novel rathole differential pressure balanced firing system which includes a ball release sleeve holding a firing piston and means for initially opening a top end and a bottom end of the ball release sleeve to the rathole annulus below the packer. A plurality of sequentially operable hydraulic systems are disposed between the firing system and the packer. The bottom end of the piston that moves the ball release sleeve is initially open to the rathole annulus below the packer but is subsequently closed to the rathole annulus below the packer and reopened to the annulus above the packer when the packer is set, a significant pressure above rathole hydrostatic pressure is applied to the annulus above the packer, and the plurality of hydraulic systems have been sequentially operated. When the bottom end of the release piston is opened to the annulus above the packer, the significant pressure, above rathole hydrostatic pressure, exists at the bottom end of the release piston; however, rathole hydrostatic pressure exists at the top end of the piston; as a result, a differential pressure exists across the release piston. Due to this differential pressure, the release piston moves up, pulling the ball release sleeve up and over the locking balls thereby releasing the firing pin; as a result, since the firing pin is released, the rathole pressure pushes the pin down, the pin impacting a primer and detonating the perforating apparatus.

Some of the hydraulic systems are debris traps; however, the other remaining hydraulic systems include a first flow passage communicating the rathole annulus to the top end of the release piston, a second flow passage communicating the bottom end of the release piston to the annulus above the packer; and an isolation piston or switching valve interposed between the first and second flow passages for moving and thereby closing off the first flow passage and opening the second flow passage in response to the significant pressure applied to the annulus above the packer. Each of the remaining hydraulic systems is operated by first moving the isolation piston or switching valve in response to the significant pressure, above rathole hydrostatic, applied to the annulus above the packer; and secondly, closing off the first flow passage to the rathole annulus and opening the second flow passage to the annulus above the packer in response to movement of the isolation piston.

Furthermore, in accordance with another aspect of the present invention, the subject differential pressure firing system is a "fullbore" system. One of the beneficial features of such a "fullbore" differential pressure firing system (which is also fullbore through the packer) is that the perforating guns can be easily dropped off after the guns have been fired. Dropping the guns breaks the flowline at some point; therefore, an isolating piston is required at the top of the packer to prevent direct communication between the annulus and the rathole. In other systems, this piston creates a closed volume in which temperature changes can cause significant pressure changes unless sufficient expansion is allowed. Similarly, in other systems, careful filling of the system is required to avoid trapping air bubbles. To keep the compensation requirement small, the closed volumes are generally kept small. One way the compensation is kept small is by limiting the distance between the packer and the firing head. In accordance with another aspect of the present invention, the firing head can be placed quite some distance from the packer. With a conventional closed system, this increase in closed volume would require a large compensation volume for temperature and would be difficult to fill without trapping air. The new and improved technique of the present invention avoids these problems by restricting the closed volume to that required to transfer the operating pressure from above the packer to below the packer. The rest of the flow line is open to well fluid and therefore, does not need to be compensated. Also, perfect air free filling is not needed because the well fluid will replace any voids.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 6*a*–6*c* illustrate the production valve; and

FIGS. 7*a*–7*b* illustrate the firing head assembly.

DETAILED DESCRIPTION OF THE PREFERRED EMBODIMENT

Figure 1:
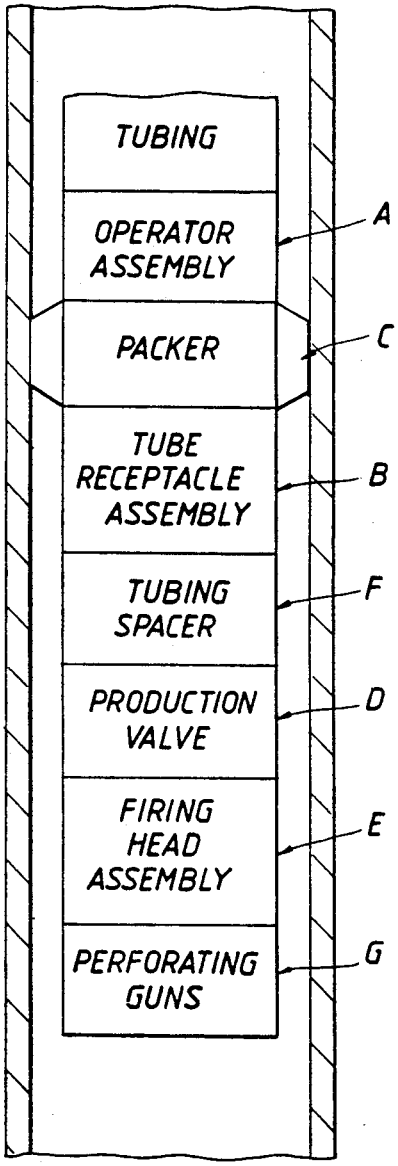
FIG. 1 illustrates a rathole differential pressure balanced firing system adapted for use with a perforating apparatus including an operator assembly, tube receptacle assembly, production valve, and firing head assembly.

Referring to FIG. 1, a differential pressure firing system (hereinafter, "DPF System"), adapted for use in a perforating apparatus, is illustrated.

In FIG. 1, the DPF System comprises a plurality of key tools including an operator assembly A, a tube receptacle assembly B displaced from the operator assembly A in the wellbore by a packer C, a production valve D which may be optionally displaced from the tube receptacle assembly B by a tubing spacer F, a firing head assembly E which is connected to the production valve D when the production valve D is part of the tool string of FIG. 1 otherwise is connected to the tubing spacer F when the production valve D is not part of the tool string of FIG. 1, and one or more perforating guns G connected to the firing head assembly E. The operator assembly A, tube receptacle assembly B, production valve D, and firing head assembly E will be discussed below with reference to FIGS. 2–7*b* of the drawings. In the following discussion, the term "annulus above the packer" refers to the annulus area around the operator assembly A above packer C in the wellbore of FIG. 1, and the term "rathole" or "rathole annulus" refers to the annulus area around the tube receptacle assembly B, production valve D, and firing head assembly E below the packer C in the wellbore of FIG. 1.

The Operator Assembly A, which includes a hydraulic passage that communicates to the tools below, transmits the above packer annulus pressure, via the hydraulic passage, to the tools below the packer C without co-mingling this pressure with either tubing pressure (the pressure within the fullbore) or below packer rathole pressure, and while providing maximum inner diameter (ID) for flowing the well. The operator assembly A includes a flow tube 80 (FIG. 2), a long tube that runs through the packer C and seals in the Tube Receptacle Assembly B. An annular space between the flow tube 80 of FIG. 2 and the ID of the Packer C is used as the hydraulic passage for transmitting the above packer annulus pressure to the tools below.

The tube receptacle assembly B, which also includes a hydraulic passage that is connected to the hydraulic passage of the operator assembly A and communicates to the tools below, receives the flow tube 80 and functions as a switching valve to allow the tools below it to be open to the rathole pressure, but only until the packer C is set and a specified pressure, above hydrostatic, is applied to the annulus above the packer, at which time, the tube receptacle assembly B closes off communication between the hydraulic passage and the rathole and opens communication between the hydraulic passage and the annulus above the packer C; this opens communication between the annulus above packer C and the tools below. However, prior to application of the specified pressure to the annulus above the packer C, when the production valve D is not used, the tube receptacle assembly B keeps the hydraulic passage, which is disposed between it and the firing head assembly E, open to rathole pressure and the firing head assembly E balanced with rathole pressure.

When the production valve D is disposed between the tube receptacle assembly B and the firing head assembly E, the operating mechanism of the production valve D is also balanced with rathole pressure. The production valve D is a multiple purpose tool; it contains production flow ports which communicate the rathole to the inner diameter of the valve D, but it keeps the production flow ports closed until it is time to establish the underbalance and fire the guns, at which time, the ports are opened which sets the underbalance and provides communication between the rathole and the tubing. The production valve D also functions as a switching valve to allow the tools below it to be open to the rathole pressure until the packer C is set and a specified pressure, above hydrostatic, is applied to the annulus above the packer, at which time, it closes off the rathole pressure and opens communication between the above packer annulus pressure and the tools below.

The Firing Head Assembly E is a redundant system, that is, the redundant system includes the aforementioned DPF System, and a trigger charge firing (TCF) system or a bar hydrostatic firing (BHF) system adapted to provide the redundancy.

Other tools can be placed in the string of FIG. 1, such as Fill-up Valves and Production Valves, that create an underbalance after the guns fire, each functioning as a switching valve in addition to performing its primary function, each allowing the tools below it to be open to rathole pressure until the annulus pressure above the packer is raised to a specified value, at which time, the rathole pressure is closed off, the tool performs its primary function, and the annulus pressure above the packer is applied to the tools below.

The key tools shown in FIG. 1, including the operator assembly A, the tube receptacle assembly B, the production valve D, and the firing head assembly E, will be discussed in detail below with reference to FIGS. 2–7*b*. In the following discussion, it will become evident that the operator assembly A, the tube receptacle assembly, and the production valve D each contain a portion of two independent hydraulic systems.

Figure 2:
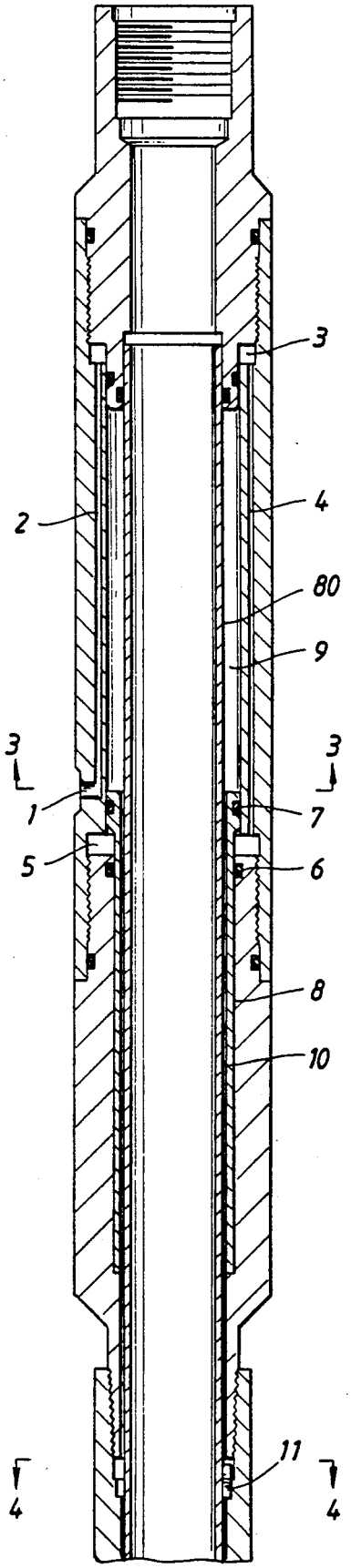
FIGS. 2–4 illustrates the operator assembly.
Figure 3:
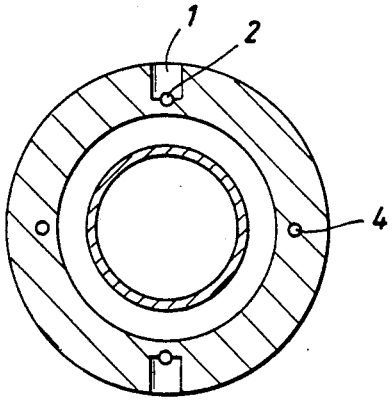
Figure 4:
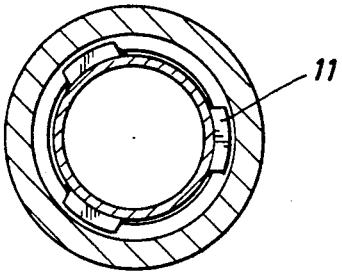

Referring to FIG. 2, the operator assembly A is illustrated. FIG. 3 is a cross-section of the operator assembly A of FIG. 2 taken along section lines 3-3 of FIG. 2. FIG. 4 is also a cross-section of the operator assembly A of FIG. 2 taken along section lines 4—4 of FIG. 2.

In FIGS. 2–4, starting at the top, the operator assembly A comprises a debris trap 1 or hydraulic system 1 which consists of a port 1 (FIG. 3), a passage 2, a circular passage 3 (FIG. 2), a passage 4, and a circular passage 5. Port 1 is disposed above the packer C and receives the annulus pressure above the packer C. Prior to running into the well, the debris trap 1 or hydraulic system 1 is filled with hydraulic oil. The operator assembly A further includes a hydraulic system 2 which consists of a chamber 9 that also contains hydraulic oil, a circular passage 10, a circular passage 12 (FIG. 5), and a port 13. In FIG. 2, these two hydraulic systems are separated by a piston 8, and are sealed by O-ring 6 and O-ring 7. The debris trap 1 utilizes the differences in density of the hydraulic oil and the density of the wellbore fluids to prevent debris from entering the operating areas of the tool. A flow tube 80 extends through the operator assembly A, the packer C, and the tube receptacle assembly B. The upper end of the flow tube 80 defines the inside diameter of chamber 9, circular passage 10, and circular passage 12. It also separates the aforementioned hydraulic systems 1 and 2 from the tubing fluids. Hydraulic systems 1 and 2, beginning with port 1 of FIG. 3 and ending with port 13 of FIG. 5, define a first hydraulic passage which opens on one end, adjacent port 1, to the annulus area above the packer C and terminates on the other end at port 13. In operation, referring to FIG. 2, as the tools of FIG. 1 are lowered into the well, the hydraulic oil in the debris trap 1 expands and, as it does, oil is forced out through port 1, thus keeping the debris out of the tool. Conversely, as the tools are lowered into the well, increased hydrostatic pressure compresses the oil in both the debris trap 1 or hydraulic system 1 and in chamber 9 (part of hydraulic system 2). As this oil is compressed, piston 8 moves upward slightly. As piston 8 moves upward, circular passage 5 becomes larger; as a result, wellbore fluid is drawn into the tool. Due to the differences in the densities of the hydraulic oil and the wellbore fluid, hydraulic oil will always remain at the top of passage 2 and passage 4, until the volume of wellbore fluid entering the system is greater than the volume of passage 2.

Figure 5:
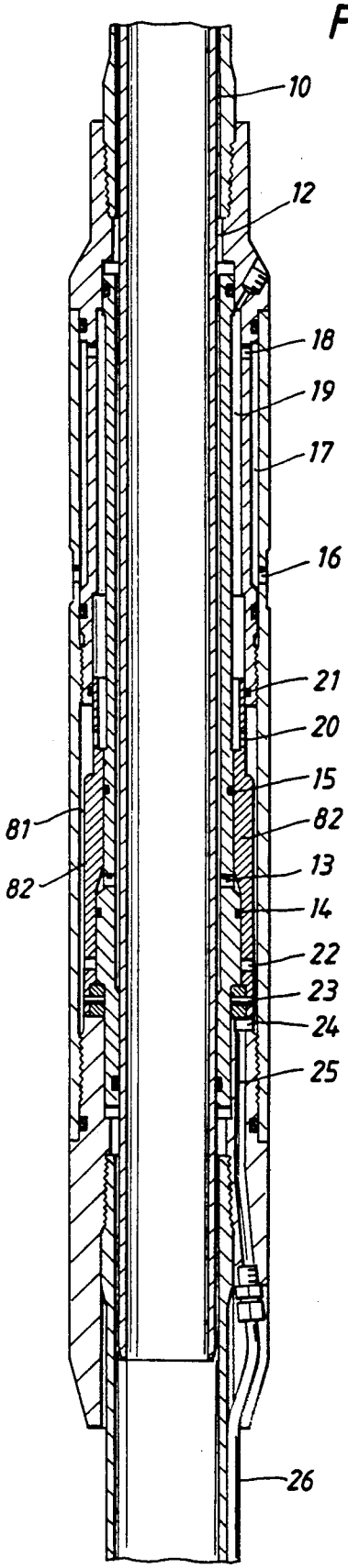
FIG. 5 illustrates the tube receptacle assembly.

Referring to FIG. 5, the tube receptacle assembly B is illustrated.

In FIG. 5, the tube receptacle assembly B is run directly on the bottom of the packer C. The purpose of the tube receptacle assembly B is two fold: first, it provides a means of transferring the hydraulic pressure from inside the tool string to a hydraulic line 26, running down the outside of the spacer tubing F, to other tools such as a production valve D or a firing head assembly E, and secondly, the tube receptacle assembly B utilizes a novel feature, unique to the DPF System, in that it provides a means of keeping the next hydraulically operated tool below it pressure balanced at rathole pressure until the packer C is set and a significant pressure is applied to the annulus above the packer C. This feature will be described in detail later. The tube receptacle assembly B also contains two hydraulic systems, that is, it contains the lower end of the hydraulic system 2 which enters the tool at the top via circular passage 10 and continues downward through circular passage 12, and port 13 where O-ring 15 and O-ring 14 separate it from hydraulic system 3; and it contains the beginning of a hydraulic system 3. Hydraulic system 3 consists of a debris trap 2, which includes port 16, circular passage 17, port 18, and circular passage 19, port 20, circular passage 81, slot 24, passage 25 and hydraulic line 26 which communicates with the tools below. The debris trap 2 utilizes the difference in densities of the hydraulic oil and wellbore fluid to prevent debris from entering the system. Hydraulic system 2 is isolated from hydraulic system 3 by isolation valve 82 shown in FIG. 5. Isolation valve 82 is held in place by shear pins 23 and includes a port 22 which is adapted to mate with port 13. As mentioned earlier, hydraulic systems 1 and 2, beginning with port 1 of FIG. 3 and ending with port 13 of FIG. 5, define a first hydraulic passage which opens on one end, adjacent port 1, to the annulus area above the packer C and terminates on the other end at port 13. However, hydraulic system 3, beginning with port 16 and ending with passage 25 and hydraulic line 26 defines a second hydraulic passage which opens one one end, adjacent port 16, to the rathole annulus and terminates on the other end at hydraulic line 26 leading to the tools below. Isolation valve 82 separates the first hydraulic passage from the second hydraulic passage. When port 22 of isolation valve 82 mates with port 13 in FIG. 5, the rathole annulus at port 16 is closed off because port 20 moves past O-ring 21, and the annulus above the packer C is opened because circular passage 12 communicates with slot 24 and passage 25 via ports 13 and 22.

As FIG. 5 illustrates, hydraulic system 3 of the tube receptacle assembly B is open to the rathole annulus at port 16 so that the next hydraulically operated tool below this point in the tool string will be pressure balanced at rathole pressure until the packer C is set and a specified pressure above rathole hydrostatic is applied to the annulus above the packer C. The effect of hydraulic oil expansion due to temperature and the hydraulic oil compression due to increased hydrostatic pressure as the tools are run in the hole are offset by the hydraulic system 3, since hydraulic system 3 is open to the rathole. In addition, the fact that hydraulic system 3 is open to the rathole at the top eliminates the problems associated with closed hydraulic systems, previously discussed in the background section of this specification. If a production valve D (FIG. 6a and 6b) is used, hydraulic system 3 enters the production valve D through passage 27 and includes circular passage 28, circular passage 29, port 30, and ends with O-ring 31 and O-ring 32. If the production valve D is not used, the hydraulic line 26 goes directly to the hydraulic line 61 (FIG. 7a) of firing head assembly E. In FIG. 5, the hydraulic system 2 and hydraulic system 3 are separated by isolation valve 82, sealed by O-ring 14 and O-ring 15. With the packer C not set, the isolation valve 82 is pressure balanced. Pressure from hydraulic system 2 acts upward on an area equal to the difference in the seal bore where O-ring 14 seals and the seal bore where O-ring 15 seals. Rathole pressure from hydraulic system 3 acts on isolation valve 82 in three places. Hydraulic system 3 pressure acts downward on an area equal to the difference in the area of the sealing surface of O-ring 21 and the area of the sealing surface for O-ring 15. Hydraulic system 3 pressure acts downward from the sealing surface for O-ring 21 to the outer diameter of the isolation valve 82 and upward from the sealing surface of O-ring 14 to the outer diameter of the isolation valve 82. Summing these areas, as long as the packer C is not set or the annular pressure above the packer is equal to the rathole pressure below the packer, there is no hydraulic force applied to the isolation valve 82.

Referring to FIGS. 6a–6b, the production valve D is illustrated. FIG. 6c illustrates a cross section of the production valve D taken along section lines 6c—6c of FIG. 6b.

In FIGS. 6a–6b, the production valve Assembly D, like the tube receptacle assembly B, contains a debris trap 3 which consists of port 33, circular passage 34, circular passage 35, and circular passage 36. The debris trap 3 utilizes the difference in densities of the hydraulic oil and wellbore fluid to prevent debris from entering the system. As shown in FIG. 6a, the production valve assembly D includes a hydraulic system 4 defining a third hydraulic passage which is open to the rathole consisting of the debris trap 3, port 37, circular passage 40, circular passage 46, port 48, circular passage 49, passage 50, and hydraulic line 51 (communicating with the tools below). Since port 33 is open to the rathole, the next hydraulically operated tool below the production valve D in the tool string of FIG. 1 is rathole pressure balanced and will remain pressure balanced until the packer C is set and a specified pressure above rathole hydrostatic pressure is applied to the annulus above the packer C. A fourth hydraulic passage is open to the rathole until the next tool above is shifted and opens the passage to the annulus above the packer C and consists of passage 27 from the tube receptacle assembly B, circular passage 29 (FIG. 6a) and port 30. Annular valve 42 includes a port 41; it isolates the third hydraulic passage from the fourth hydraulic passage, but, when the annular valve 42 moves upwardly in response to the pressure in the annulus above the packer, it closes off communcation with the rathole because port 37 moves past O-ring 38 and opens up communication with the annulus above the packer C because port 30 aligns with port 41. Annular valve 42 moves upwardly primarily due to the location of port 30 in FIG. 6b, that is, port 30 terminates at an underside of the annular valve 42 as shown in FIG. 6b. However, port 30 is adapted to align with port 41 when a pressure in the annulus above the packer C, above rathole hydrostatic pressure, is exerted on the undeside of annular valve 42 via circular passage 29 and port 30 and moves annular valve 42 upwardly which causes port 30 to align with port 41. A port valve 43 is connected to the annular valve 42 and includes an O-ring 52 and an O-ring 53, the O-rings 52 and 53 initially isolating and closing off a plurality of production ports 45 which are shown in FIG. 6*c*. However, when the annular valve 42 moves, port valve 43 also moves; as a result, o-ring 52 moves past the production ports 45 thereby opening the production ports 45. Consequently, when port 30 aligns with port 41 in FIG. 6*b* in response to the increase in pressure in the annulus above the packer C above rathole hydrostatic pressure, O-ring 52 moves past the production ports 45 thereby opening the production ports 45.

The effect of hydraulic oil expansion due to temperature and the hydraulic oil compression due to increased hydrostatic pressure, as the tools are run in the hole, are offset by the hydraulic system 4, since the hydraulic system 4 is open to the rathole. Hydraulic system 3 and hydraulic system 4 are separated by annular valve 42, sealed by O-ring 31 and O-ring 32. With the packer C not set, the annular valve 42 is rathole pressure balanced. Pressure from hydraulic system 3 acts upward on an area equal to the difference in the seal bore where O-ring 31 seals and the seal bore where O-ring 32 seals. Pressure from hydraulic system 4 (rathole pressure) acts on annular valve 42 in four places. Hydraulic system 4 pressure acts downward on an area equal to the difference in the area of the sealing surface for O-ring 38 and the area of the sealing surface for O-ring 32. Hydraulic system 4 pressure acts downward from the sealing surface for O-ring 38 to the outer diameter of the annular valve 42. Since annular valve 42 and port valve 43 are threadably connected, they act as one member hydraulically. Rathole pressure passes through port 41 into circular passage 44 so that rathole pressure acts downward from the sealing surface of O-ring 31 to the sealing surface of O-ring 83. Hydraulic system 4 pressure also acts upward from the outer diameter of the port valve 43 to the sealing surface of O-ring 53. Since O-ring 52, O-ring 53 and O-ring 84 all seal on equal diameters, tubing pressure has no effect on the combined annular valve and port valve, i.e., the tool is pressure balanced to tubing pressure. Summing these areas, so long as the packer is not set or the annular pressure above the packer is equal the rathole pressure below the packer, there is no hydraulic force applied to the annular valve 42/port valve 43 combination. Shear pins 47 also hold the two valves in position. Port valve 43 initially closes off the production ports 45 until such time that the annulus pressure above the packer C is increased to the prescribed rathole operating pressure, at which time, and the annular valve 42 closes off hydraulic system 4 from the rathole and opens it to the hydraulic System 3 which leads to the annulus above the packer. When a production valve D is used, hydraulic line 51 extends downward to the firing head assembly E. If no production valve D is used, hydraulic line 26 extends downward to the firing head assembly E.

Referring to FIGS. 7*a*–7*b*, the firing head assembly E is illustrated.

In FIGS. 7*a*–7*b*, hydraulic system 4 pressure enters the firing head assembly E through redundant head 85 via passage 58.

Passage 58 opens downward into passage 59 (FIG. 7*b*) which connects to passage 60. Passage 60 opens downward into passage 61 which opens into passage 62 which connects with port 63. Port 63 connects to circular passage 64 so that hydraulic system 4 pressure is applied to the bottom side of piston 71 on an area equal to the difference in the area of the sealing surface of O-ring 66 and the area of the sealing surface O-ring 79. As long as the top of hydraulic system 4 is open to the rathole, the upward force created by hydraulic system 4 pressure acting on the bottom side of piston 71 is offset by the rathole pressure acting on the top side of piston 71. This rathole pressure, acting on the top side of piston 71, enters the system through port 68 and is transmitted upward along circular passage 69, through port 78, into circular passage 86 where it acts downward on the area between O-ring 66 and O-ring 79, thus balancing the piston so long as hydraulic system 4 pressure acting on one side of piston 71 is equal to rathole pressure acting on the other side of piston 71. Piston 71 is threadably connected to ball release sleeve 72. Shear pins 67 also lock piston 71 to shear pin housing 87 until sufficient differential pressure is applied to piston 71. When sufficient differential pressure is applied to piston 71 (via increasing annulus pressure above the packer C and operating all switching valves in the tool above so that hydraulic system 4 pressure is equal to above packer annulus pressure), piston 71 and ball release sleeve 72 move upward until locking balls 74 are uncovered. Locking Balls 74 are urged outward by the firing pin 76, since the pin 76 tries to move downward. Rathole pressure enters the tool via port 68 and is transmitted upward along circular passage 69, through port 70 and port 73, acting downward on firing pin 76 with a force created by the rathole pressure acting on an area equal to the sealing surface for O-ring 75. When the ball release sleeve 72 uncovers the locking balls 74, the balls pop out and the firing pin 76 moves downward into the air chamber 88, striking detonator 77 with sufficient force to initiate it and the perforating guns below. In other words, the guns can only be fired when the packer C is set, the annulus pressure above the packer C is increased to a prescribed amount above hydrostatic pressure, and all hydraulically operated tools between the packer C and the firing head E have functioned properly, closing off all rathole equalization features and opening communication between the annulus above the packer to the firing head assembly E.

A functional description of the differential pressure firing system of the present invention will be set forth in the following paragraphs in connection with a typical job sequence with reference to FIGS. 1–7*b* of the drawings.

Fluid is added to the tubing string as the tools of FIG. 1 are lowered into the borehole in order to provide the correct underbalance. When the proper depth is reached and the setting depth is correlated, the packer C is set. At this time, all tools are positioned as shown in FIG. 1. Annulus pressure above the packer C and rathole pressure below the packer C are equal. When it is desired to set the underbalance and perforate the well, the annulus pressure above the packer C is slowly increased. As the pressure increases, this increase in pressure above packer C is transmitted through port 1, upward along passage 2, around circular passage 3, downward along passage 4 to circular passage 5. Here, it acts upward on piston 8, urging it upward into chamber 9. As piston 8 moves into chamber 9, it increases the pressure in chamber 9 so that it stays equal to the total annulus pressure above the packer C. This pressure increase is transmitted to circular passage 10, circular passage 12, and through port 13 so that it is acting upward on isolation valve 82. When the increased pressure acting on the area between the sealing surface of O-ring 14 and the sealing surface of O-ring 15 is sufficient to break shear pins 23, isolation valve 82 moves upward.

As isolation valve 82 moves upward, port 20 passes O-ring 21, closing off rathole pressure to the tools below.

Simultaneously, port 22 passes O-ring 14, so that the pressure from circular passage 12 is transmitted through port 22 to circular passage 81, downward to slot 24, through passage 25 and downward to hydraulic line 26. Hydraulic line 26 carries the increased pressure downward past the tubing spacer to the production valve D. The pressure from hydraulic line 26 enters the production valve D at passage 27 and travels downward to circular passage 28, downward through circular passage 29, to port 30. When the pressure increase, working on the area between the sealing surface of O-ring 31 and the sealing surface of O-ring 32 is great enough to break shear pins 47, the annular valve 42 moves upward. As the annular valve 42 moves upward, port 37 passes under O-ring 38, isolating the rathole pressure from the tools below. Simultaneously, port 41 passes O-ring 31, so that pressure from circular passage 29 is transmitted through port 41 to circular passage 40 and downward through the circular passage 40 to port 48, into circular passage 49, downward through passage 50 to hydraulic line 51. When Port 41 opens, O-ring 52 passes production port 45, opening these ports and reducing the rathole pressure to tubing pressure, thus setting the underbalance pressure in the area to be perforated. Hydraulic line 51 carries the increased annulus pressure (above packer annulus pressure) past the tubing spacer F and tube holding coupling 57 to the firing head assembly E. The increased hydraulic pressure in hydraulic line 51 enters the redundant head adapter 85 through Passage 58. Passage 58 opens into passage 59 which connects to passage 60 that opens into passage 61. Passage 61 opens into passage 62 where port 63 opens into circular passage 64. The top of passage 64 exposes the pressure to piston 71 where the increased (differential) pressure works upward on an area between O-ring 66 and O-ring 79. When the force on piston 71 is great enough to break shear pins 67, piston 71 and ball release sleeve 72 move upward uncovering the locking balls 74, causing the locking balls 74 to pop out, releasing firing pin 76, thus firing the perforating guns. As the well begins to flow, the rathole fluids and the formation fluids and gases then flow upward to the open production ports 45, into the inner diameter of the production valve D and up the string to the tubing and on to the surface.

The invention being thus described, it will be obvious that the same may be varied in many ways. Such variations are not to be regarded as a departure from the spirit and scope of the invention, and all such modifications as would be obvious to one skilled in the art are intended to be included Within the scope of the following claims.

We claim:

1. A firing system adapted to be disposed below a packer in a wellbore, said packer defining a rathole annulus below said packer and another annulus above said packer, comprising:

first means for defining a first hydraulic passage between said rathole annulus and one end of said firing system;

second means for defining a second hydraulic passage between said rathole annulus and another end of said firing system, said firing system being rathole pressure balanced when the ends of said firing system are open to said rathole annulus;

third means for defining a third hydraulic passage between said another end of said firing system and said another annulus above said packer; and fourth means responsive to a first pressure in the annulus above said packer for closing said second hydraulic passage and opening said third hydraulic passage in response to said first pressure when said packer is set and said first pressure in the annulus above said packer is greater than a second pressure in said rathole annulus.

2. The firing system of claim 1, wherein said fourth means comprises a plurality of sequentially operable systems, the fourth means closing said second hydraulic passage and opening said third hydraulic passage in response to said first pressure when said packer is set, said first pressure is greater than said second pressure, and the plurality of systems is sequentially operated.

3. The firing system of claim 2, wherein said second hydraulic passage of said second means includes a debris trap means for preventing debris in the rathole annulus from entering said second hydraulic passage.

4. A well apparatus including packer and a firing system adapted to be disposed below said packer in a wellbore when said packer is set thereby isolating an annulus above said packer from a rathole annulus below said packer, a pressure in said rathole annulus being a first pressure, one end of said firing system having a first port which is open to said rathole annulus, comprising:

first means including a second port and connected between said packer and said firing system in said wellbore for opening said second port to the rathole annulus thereby defining a hydraulic passage between the rathole annulus and the other end of said firing system, said first means maintaining said second port open to said rathole annulus until said packer is set and a second pressure is applied to said annulus above said packer, the ends of said firing system being pressure balanced when the first and second ports are open to said rathole annulus; and second means disposed above said packer in said wellbore and responsive to said second pressure in said annulus above said packer for propagating said second pressure to said first means, said first means closing said second port to said rathole annulus and opening a third port to said annulus above said packer in response to said second pressure thereby defining another hydraulic passage between the annulus above said packer and the other end of said firing system when said packer is set and said second pressure is greater than said first pressure.

5. The well apparatus of claim 4, wherein a difference in pressure between said second pressure and said first pressure exists across the ends of said firing system when the first port is open to said rathole annulus, said second port is closed to said rathole annulus, and said third port is open to said annulus above said packer, said difference in pressure detonating said firing system.

6. A well apparatus including packer and a firing system adapted to be disposed below said packer in a wellbore when said packer is set thereby isolating an annulus above said packer from a rathole annulus below said packer, one end of said firing system being open to said rathole annulus, a pressure in said rathole annulus being a first pressure, a pressure in said annulus above said packer being a second pressure, comprising:

apparatus connected between said packer and said firing system in said wellbore, said apparatus including, a first hydraulic passage communicating with said annulus above said packer;

a second hydraulic passage communicating with said rathole annulus, a common hydraulic passage communicable with either said first hydraulic passage or said second hydraulic passage, on one end, and with the other end of said firing system on the other end; and switch means disposed between said common hydraulic passage and the first and second hydraulic passages for initially maintaining a first hydraulic connection between said common hydraulic passage and said second hydraulic passage when said packer is not set or said second pressure is equal to said first pressure, the other end of said firing system being open to the rathole annulus when the switch means maintains said first hydraulic connection, the ends of said firing system being pressure balanced when the ends of said firing system are open to the rathole annulus.

7. The well apparatus of claim 6, wherein said switch means closes said first hydraulic connection between the common hydraulic passage and said second hydraulic passage and opens a second hydraulic connection between said common hydraulic passage and said first hydraulic passage in response to said second pressure when said packer is set and said second pressure is greater than said first pressure, a pressure differential existing across the ends of said firing system when said first hydraulic connection is closed and said second hydraulic connection is opened, said firing system detonating in response to said pressure differential.

8. A system adapted to be disposed in a borehole when a packer is set in said borehole thereby defining a rathole annulus below the set packer and an annulus above the packer, comprising a first apparatus connected to and disposed below the set packer in the borehole, said first apparatus including a first hydraulic passage communicating with the annulus above the packer, a second hydraulic passage communicating with the rathole annulus, a third hydraulic passage communicable with either the first or second hydraulic passages, and a first switch means disposed between the third hydraulic passage and the first and second hydraulic passages for closing communication between the third hydraulic passage and the second hydraulic passage in response to a pressure in said annulus above said packer and opening communication between said third hydraulic passage and said first hydraulic passage;

a second apparatus connected to and disposed below the first apparatus in the borehole, said second apparatus including said third hydraulic passage communicating with the annulus above the packer via said first apparatus when said first switch means opens communication between said third hydraulic passage and said first hydraulic passage in response to said pressure in said annulus above said packer, a fourth hydraulic passage communicating with the rathole annulus, a fifth hydraulic passage communicable with either said third or fourth hydraulic passages, and a second switch means disposed between the fifth hydraulic passage and the third and fourth hydraulic passages for closing communication between the fifth hydraulic passage and the fourth hydraulic passage in response to said pressure in said annulus above said packer which exists within said third hydraulic passage and opening communication between said fifth hydraulic passage and said third hydraulic passage; and a firing system disposed below said second apparatus and connected to said fifth hydraulic passage of said second apparatus, said firing system including a sixth hydraulic passage communicating said rathole annulus with a bottom part of said firing system and a seventh hydraulic passage communicating said fifth hydraulic passage with a top part of said firing system, a differential pressure existing across said firing system when said pressure in said annulus above said packer which exists within the fifth and seventh hydraulic passages is greater than a pressure in said rathole annulus which exists within said sixth hydraulic passage, the differential pressure across said firing system detonating said firing system.

9. A method of safely locating a firing system in a wellbore, said firing system being located in said wellbore when a packer connected above said firing system in said wellbore is set thereby isolating a rathole annulus below said packer from an annulus above said packer, said firing system including a firing apparatus, comprising the step of:

opening a top end and a bottom end of said firing apparatus to said rathole annulus when said firing system is initially disposed in said wellbore, said firing apparatus being pressure balanced at a rathole pressure when the top and bottom ends of said firing apparatus are open to said rathole annulus; and maintaining the top end and the bottom end of said firing apparatus open to said rathole annulus until said packer is set in said wellbore and a pressure in said annulus above said packer is increased to a point which exceeds a pressure in said rathole annulus.

10. A method of detonating a firing system disposed in a wellbore, said firing system being disposed in said wellbore when a packer connected above said firing system in said wellbore is set thereby isolating a rathole annulus below said packer from an annulus above said packer, said firing system including a firing apparatus, comprising the step of:

opening one end and the other end of said firing apparatus to said rathole annulus when said firing system is initially disposed in said wellbore, said firing apparatus being pressure balanced at a rathole pressure when the one end and the other end of said firing apparatus are open to said rathole annulus;

setting said packer;

applying a pressure to the annulus above the set packer;

when the pressure in the annulus above said packer exceeds the rathole pressure, closing the one end of said firing apparatus to said rathole annulus and opening the one end of said firing apparatus to the annulus above said packer;

when said one end of said firing apparatus is opened to the annulus above said packer, applying the pressure in the annulus above said packer to the one end of said firing apparatus, a differential pressure existing between the one end and the other end of said firing apparatus, said firing system detonating in response to said differential pressure.

* * * * *